United States Patent [19]

Champeau

[11] Patent Number: 5,068,632

[45] Date of Patent: Nov. 26, 1991

[54] SEMI-RIGID CABLE DESIGNED FOR THE TRANSMISSION OF MICROWAVES

[75] Inventor: André Champeau, Orsay, France

[73] Assignee: Thomson-CSF, Puteaux, France

[21] Appl. No.: 451,821

[22] Filed: Dec. 15, 1989

[30] Foreign Application Priority Data

Dec. 20, 1988 [FR] France ..... 88 16811

[51] Int. Cl.[5] ..... H01P 3/08

[52] U.S. Cl. ..... 333/238; 333/246; 174/117 FF; 174/36

[58] Field of Search ..... 333/238, 243, 246; 174/32, 117 FF, 36

[56] References Cited

U.S. PATENT DOCUMENTS

| | | | |
|---|---|---|---|
| 2,994,050 | 7/1961 | Ayer et al. | 333/238 |
| 3,004,229 | 10/1961 | Stearns | 333/238 |
| 3,258,724 | 6/1966 | Walsh et al. | 333/238 |
| 3,612,744 | 10/1971 | Thomas | 333/238 X |
| 4,382,236 | 5/1983 | Suzuki | 333/238 X |
| 4,673,904 | 6/1987 | Landis | 333/238 |
| 4,701,727 | 10/1987 | Wong | 333/204 |
| 4,707,671 | 11/1987 | Suzuki et al. | 333/243 X |
| 4,845,311 | 7/1989 | Schreiber et al. | 333/243 X |

FOREIGN PATENT DOCUMENTS

| | | | |
|---|---|---|---|
| 2139064 | 2/1972 | Fed. Rep. of Germany | 333/238 |
| 846922 | 10/1961 | France | 174/36 |
| 798629 | 7/1958 | United Kingdom . | |
| 1473655 | 5/1977 | United Kingdom . | |

OTHER PUBLICATIONS

Patrick, R. M.; "Flexible Strip Transmission Line"; *IBM Technical Disclosure Bulletin;* vol. 2, No. 6, Apr. 1960; pp. 35, 36.

The Design of Microwave Components, vol. 105 B, No. 20, Mar. 1958, pp. 155–172.

Microwave Journal, vol. 18, No. 8, Aug. 1975, pp. 49–51.

*Primary Examiner*—Paul Gensler
*Assistant Examiner*—Benny T. Lee
*Attorney, Agent, or Firm*—Roland Plottel

[57] ABSTRACT

A semi-rigid cable for the transmission of microwaves, such as those used for radar or for digital television. This cable has a symmetrical strip line with a dielectric having an almost rectangular section, with a width close to the thickness of the dielectric and external conductive strips with a width that is substantially greater than that of the central conductor. This symmetrical strip line is advantageously surrounded by an absorbent sheath. The entire unit is protected by an ordinary metallic shielding and by a standard external mechanical protective sheath.

7 Claims, 2 Drawing Sheets

SEMI-RIGID CABLE DESIGNED FOR THE TRANSMISSION OF MICROWAVES

BACKGROUND OF THE INVENTION

1. Field of the Invention

The present invention relates to a semi-rigid cable designed for the transmission of microwaves such as the waves used, for example, in radar or for cable television broadcasting, notably high definition digital television.

2. Description of the Prior Art

At present, the growing tendency with radar antennas is to make surface sampled active antennas which are, therefore, formed by a very great number of radiating and active elementary modules, each of these modules having an elementary transmitter and an elementary receiver which are proper to it. A radar antenna of this type, having dimensions generally of several meters, i.e. height and width, may comprise up to several thousands of these elementary transmitter/receiver modules.

For this type of antenna, it should be necessary to be able to convey the following by means of a number of microwave transmission cables at least equal to the number of modules on this network of transmitters and receivers:

firstly, the driving signals for the transmission;

secondly, the demodulation signals (the signal of the local oscillator for the reception function).

The signals picked up by these elementary receivers should be further capable of being conveyed in return to the processing installation, whether they are of the digital type or of the analog type.

This type of antenna therefore has to be fitted out with a network of cables for the distribution of microwave signals which may call for the use, in all, of several kilometers of cables of this type for one and the same antenna.

These transmission cables are subjected to severe constraints and requirements. They have to be totally free from mutual crosstalk. They should be perfectly shielded from the exterior, especially so that they are prevented from picking up the stray signals or from being sensitive to jamming or interference. Finally, in order to perfectly preserve the phase relationships of the illumination, there should be no phase noises: their phase should be stable and repetitive despite dismantling, transportation and re-assembly.

Cables meeting such requirements could also be necessary in the future to equip the high-definition digital television broadcasting networks. The pass-bands needed will be so high that it should be expected that there will be great difficulty in finding a sufficient number of radio channels without causing interference: it might subsequently be necessary to fall back on a cabled broadcasting system if it is desired to be able to obtain a satisfactory quality for the signals received by the users, as well as a sufficient broadcasting range.

The most widely used microwave cable is the braided metal-sheathed coaxial cable. This type of cable is not free of crosstalk unless it is double-sheathed. It thus has a central conductor with a circular section, surrounded by a dielectric which is itself surrounded by two superimposed, braided metal sheaths, with standard high-density braiding. The entire unit is, of course, covered with an external insulating sheath, capable of providing for mechanical protection and imperviousness to water. These standard cables are, however, not perfectly suitable, above all because of contact noises, called "braid noises", which tend to appear in the two superimposed braids. These braid noises, which come into play especially during vibrations or other movements of the cable, are detrimental to the efficient transmission of the microwaves. Besides, the quality of the contacts between the two braided cables changes in the course of time, especially at the ends of the cable. Furthermore these cables are subjected to phase noises which are quite detrimental in certain cases. Finally, after a cable is deflected or undergoes a cycle of temperature, the two braided sheaths do not necessarily follow a return movement and, as a result, there are changes in characteristics. This standard braided double-sheathed cable is therefore, technically, not really satisfactory for the desired use.

The known approach, which is presently the most satisfactory one from the viewpoint of performance characteristics, consists in the use of semi-rigid coaxial cables formed by a solid, metal central core surrounded by a dielectric which is, generally, a dielectric with low losses such as polyethylene or PTFE which is itself coated with an external conductor made of solid copper.

This type of solid metal-sheathed coaxial cable is, however, ill-suited to fabrication by continuous wire-drawing process. The methods used for certain cable dimensions consist in the fabrication of this external conductor by wrapping a strip of sheet metal around its longitudinal axis so as to position it edge to edge, and then in seam welding these two edges. The cable is advantageously corrugated to facilitate the shaping operations.

Whatever the case may be, this cable is every costly and cannot be made on an industrial scale except in restricted lengths. It is therefore ill-suited to the above-mentioned applications, where it is necessary to implant very large quantities of cable lengths. It further has the drawback of requiring fairly costly connectors at each end. Finally, it is ill-suited to the multiple transmission of auxiliary service signals (telephone channels, signals reporting tests on distant equipment etc.).

SUMMARY OF THE INVENTION

The invention seeks to overcome these drawbacks. To this effect, it relates to a semi-rigid cable designed for the transmission of microwaves, said cable comprising at least:

one solid central conductor which may be a standard, circular-section conductor but which is preferably formed by a metal strip;

one dielectric that coats this central conductor; the cross-section of this dielectric has a general shape which is almost rectangular, with two large, plane, external faces placed symmetrically and on either side of the central conductor so as to form the dielectrical part of a line of the symmetrical strip line type;

two external conductive layers, formed by continuous metal strips respectively coating at least the major part, of the width, of each of the two large plane faces of the almost-rectangular section of the dielectric so as to form a symmetrical strip line with the central conductor and the dielectric; and at least one shielding metal sheath surrounding this symmetrical strip line.

The width of each of the external conductive layers, in metal strip form, of the symmetrical strip line is generally several times greater, and preferably about three times greater, than either the spacing between these two external plane conductors (i.e. the thickness of the dielectric) or the width of the central conductor (taken in the median plane of the symmetrical strip line, parallel to these plane conductors) should this width be greater than the above-mentioned spacing between the external plane conductors. The thickness of the dielectric is, of course, chosen so that the symmetrical strip line has the desired characteristic impedance.

In practice, for the most frequently used dielectrics and for the current characteristic impedances, the thickness of the dielectric is of the same magnitude as the width of the central conductor taken in the median plane of the symmetrical strip line, that is the central plane parallel to the external plane conductors of this symmetrical strip line. For example, this thickness of the dielectric is chosen to be substantially equal to this width of the central conductor.

According to a first embodiment, the above-mentioned shielding sheath almost directly covers the symmetrical strip line. In this case, the dielectric advantageously has a greater (preferably slightly greater) width than that of the two plane external conductors of the symmetrical strip line, and the edges of the rectangle forming the section of this dielectric are rounded in that portion of this rectangle which is external to these plane conductors, so as to match the shape of the shielding sheath.

According to another more efficient, albeit more costly embodiment, between the symmetrical strip line and the above-mentioned shielding sheath, this microwave cable further includes a sheath made of a material that is absorbent for the microwaves in the spectrum of use of the cable wherein the higher modes may be propagated. The external section of this absorbent sheath preferably has an elliptical shape, the large axis of the ellipse being substantially identical with the median plane of the symmetrical strip line, which is parallel to the two external plane conductors of this line.

BRIEF DESCRIPTION OF THE DRAWINGS

The invention will be better understood and its advantages and other characteristics will emerge in the course of the following description of two non-restrictive embodiments of this semi-rigid cable for microwaves, with reference to the schematic drawing wherein.

DESCRIPTION OF THE PREFERRED EMBODIMENTS

Figure 1:
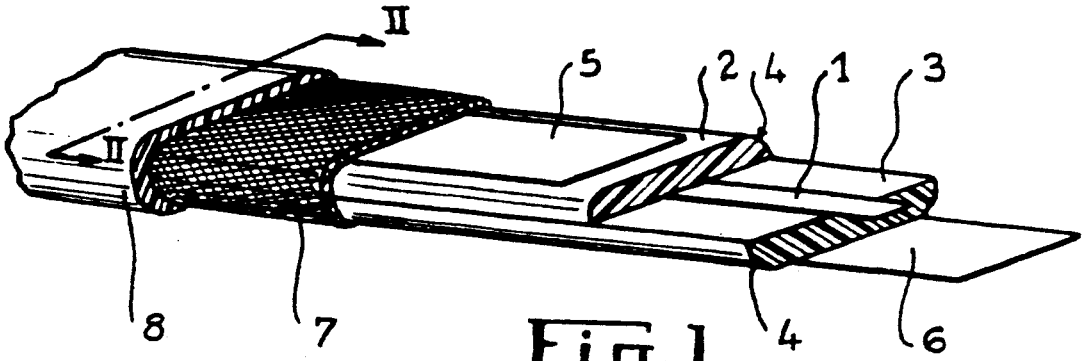
FIG. 1 shows a cutaway view in perspective of a first embodiment of the cable.
Figure 2:
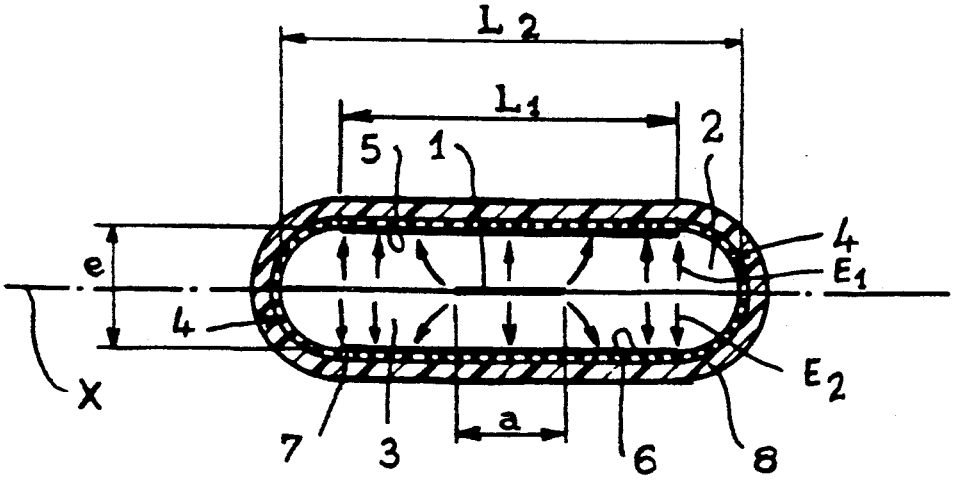
FIG. 2 shows a cross-sectional view along II—II of FIG. 1.

Referring firstly to FIGS. 1 and 2, this semi-rigid cable for microwaves comprises, in this first embodiment:

a central conductor 1, formed by a continuous metal strip, which is a good conductor, having a width a (see FIG. 2);

two strips, 2, 3, made of a semi-rigid dielectric material with low losses, such as a polyethylene. These two strips 2, 3 are identical and they are formed so that, when placed on top of one another as shown, they narrowly and symmetrically grip the central conductor 1, thus forming a dielectric, the section of which has a general shape of a rectangle with rounded edges. The total thickness e of the dielectric 1, 2 thus formed is chosen to be substantially equal to the width a of the strip 1, this thickness e (and hence the width a) as seen in FIG. 2, is sufficient to form a symmetrical strip line with the desired characteristic impedance. The edges 4 of the rectangle forming the section of the dielectric are rounded as shown.

two identical external conductive layers, 5, 6, each formed by a metal strip which is a good conductor. Each of these strips coats one of the plane external faces of the dielectric 2, 3 and is therefore parallel to the plane X (as seen in FIG. 2 and extending perpendicular to the drawing) containing the central strip 1. The two strips 5, 6 typically have a width $L_1$ (as seen in FIG. 2) equal to or greater than three times the width a of the central strip 1 and, with this central strip 1 and with the dielectric 2, 3, they form a symmetrical strip line with a desired characteristic impedance. The plane external faces of the two dielectric bands 2, 3 have the same width $L_1$ as these strips 5, 6. These strips 5, 6 therefore end, in the transversal direction, at the starting point of the rounded edges 4 of the external corners of the "rectangle" forming the section of the dielectric 2, 3.

an ordinary shielding sheath 7, which narrowly surrounds this symmetrical strip line 1, 2-3, 5, 6. In this example, this sheath 7 is formed by a standard metal braid. It could equally well be formed, conventionally, by a continuous metal strip folded longitudinally around the above-mentioned symmetrical strip line and closed by crimping.

a standard, external mechanical protective sheath 8, made of flexible plastic material, capable of providing for the imperviousness of the cable and for its protection against shocks and other external attacks. These sheath coats the shielding sheath 7.

Thus constituted, this cable is capable of propagating a microwave according to the first guided mode which is the electromagnetic transversal mode depicted by the arrows in FIG. 2. In the transversal direction, the two electrical field vectors $E_1$, $E_2$ (as seen in FIG. 2) are not truly equal and opposite except at a sufficient distance from the central line 1: it is only at this distance that we can be sure that they cancel each other out and do not consequently generate any electrical field leakage outwards of the symmetrical strip line. This is why the width $L_1$ of the external strips 5, 6 is chosen so as to be appreciably greater than the width a of the central strip 1.

It should be noted that propagation such as this is possible without stray signals only if the frequency of the electromagnetic wave is below the frequency of propagation of the first higher stray mode.

This frequency is given by the formula:

$$F = \frac{c}{2 \times \sqrt{Er} \times L_2}$$

where c is the speed of light, Er is the relative dielectric constant of the dielectric material, and $L_2$ is the maximum width of the strips of dielectric (see FIG. 2).

Above this frequency F, this stray mode introduces intolerable disturbances, so that this frequency F in practice limits the higher value of the pass band of the cable of FIG. 1. This is why the width $L_2$ should not be chosen to be too great either, so as not to excessively diminish the width of this pass band: the value $$L_1 \simeq 3a$$

has been chosen in this exemplary embodiment.

Should width a be chosen to be different from thickness e, the value of L may be chosen to be equal to three times the greater of the two values a and e. In other words:

$L_1 \simeq 3a$ if width a is greater than thickness e and $L_1 \simeq 3e$ if thickness e is greater than width a The external shielding sheath 7 no longer participates in the propagation of the radio-electrical wave as is the case with prior art cables. It is an ordinary shielding sheath having the function of increasing the radio-electrical imperviousness of the cable to crosstalk and interference: it creates a final barrier to outward radiation and is used to reject the signals coming in from outside. The fabrication of this sheath need not be precise since the sheath does not take part in the definition of the characteristic impedance of the line and since it is not liable to contribute to the generation of amplitude and phase noises. It may therefore be an inexpensive sheath.

The rounded edges 4 of the dielectric plates 2, 3 are designed to meet the mechanical constraints arising in the fabrication of the shielding sheath 7. For it would be difficult to obtain metal shielding which is shaped around a rectangular-sectioned bar having sharp corners: the role of the rounded edges 4 is to avert this difficulty and thus enable a metal shielding with rounded edges (hence without sharp corners) to be easily put into place.

The cable that has just been described can be made at very low cost, by using continuous wire drawing and continuous extrusion techniques.

Nonetheless, the higher value of its pass band is limited in practice by the frequency F defined above, which corresponds to the possibility of propagation of the higher stray mode. Besides, the field vectors $E_1$ and $E_2$ (FIG. 2) on the rims of the symmetrical strip line are strictly equal and opposite only if the symmetry of this symmetrical strip line is perfect from all points of view. If, on the other hand, a dissymmetry (for example if the central conductor 1 is not strictly at midpoint between the two external conductors 5 and 6 or if there are variations in index in the dielectric 2, 3 owing to lack of homogeneity) the above-mentioned two field vectors $E_1$ and $E_2$ may each have a slightly different amplitude, and they may then give rise to a small field component with an absolute value $(E_1 - E_2)$ that tends to leak outwards. This component may give rise to a propagation in stray mode for the frequencies greater than the frequency F which has been defined above, said propagation leading to absorption by resonance phenomena.

These resonance phenomena result in discrete absorptions at certain frequencies and at the harmonics of these frequencies. Furthermore, in view of the environment, multiple resonances caused by different spacings and dissymmetries, may appear. It has to be noted that the twisting of the cable during its installation necessarily creates this type of dissymmetry.

The shielding does have the role of opposing the outward propagation of a stray mode component such as this, but its efficiency is null with respect to the resonances that are internal to the line and are capable of existing as soon as the frequency reaches or exceeds the above-mentioned value F.

Figure 3:
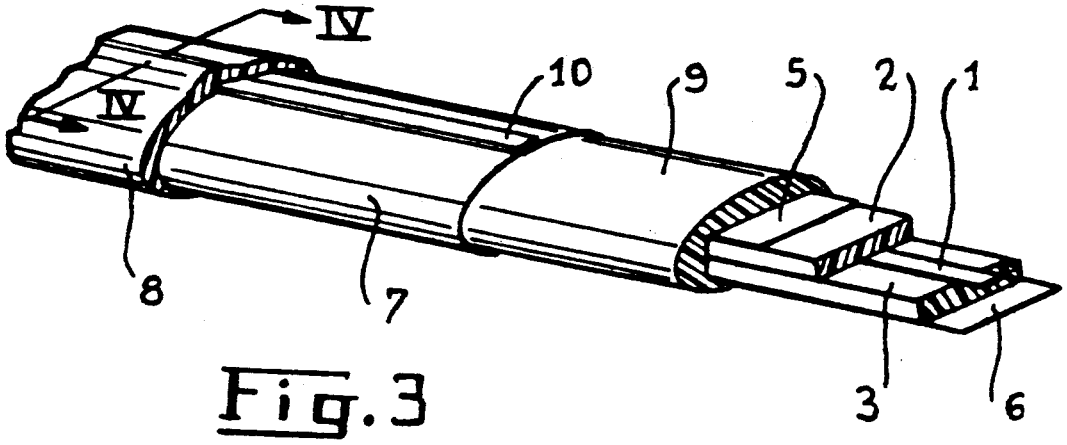
FIG. 3 shows a cutaway view in perspective of a second embodiment of this cable.
Figure 4:
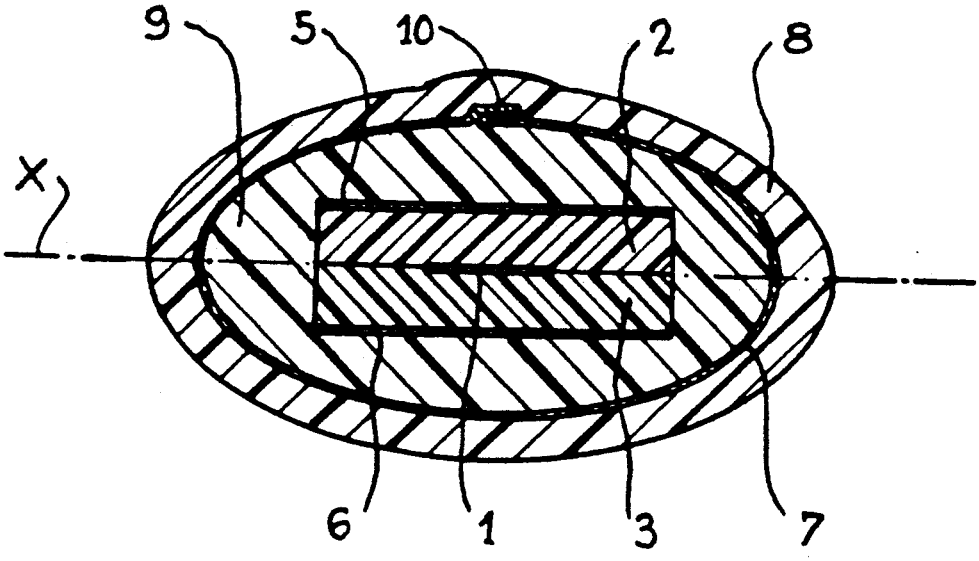
FIG. 4 shows a cross-sectional view along IV—IV of FIG. 3.

FIGS. 3 and 4 represent a second embodiment of this cable, which is more sophisticated and, hence, more costly, and has the advantage of overcoming the above-mentioned drawbacks of the cable of FIG. 1. This cable is therefore one having a wider pass-band than the earlier one, and its absorption of the small leakage component in case of dissymmetry is far more satisfactory. It can also fulfil a function of a filter absorbing harmonics at the frequencies higher than the cut-off frequency F of the first stray mode of propagation.

This second cable differs from the previous one essentially in the fact that it has, between the symmetrical strip line (1, 2, 3, 5, 6) and the metal shielding sheath 7 (which is shown, in this case, by way of illustration, as a standard sheath formed by a metal band wound in one turn around its longitudinal axis and crimped at 10), a relatively thick additional sheath 9, made of a material that is absorbent for the the microwaves throughout the spectrum of the frequencies higher than the cut-off frequency of the first stray mode capable of being propagated in the cable. The material used for the sheath 9 is, for example, a graphite-charged rubber or a rubber charged with finely divided metal oxide particles. In any case, it is formed by a very poor dielectric material.

This absorbent sheath 9 may be advantageously obtained by extrusion of a charged plastic or by the helical taping of a plastic such as this. Its external shape is preferably elliptical as shown, and the large axis of the ellipse is then identical with the median plane X of the symmetrical strip line which contains the central conductor 1. The useful volume of the absorbent sheath 9 is in fact localized around the two edges of the symmetrical strip line and, for questions of economy of material and of lower weight, it is appropriate to adopt an approach, for the section of the sheath 9, wherein the maximum amount of absorbent material is located around the rims of the external conductors 5 and 6. Besides, a rounded shape is desirable to enable the easy fabrication of the shielding sheath 7. The adapted elliptical shape meets these requirements and possesses the advantage of having a simple shape that gets closed gradually and continuously, and makes the sheath 9 easy to manufacture by drawing or extrusion.

A cable structure such as this makes it possible:

to obtain noise and stability characteristics which are as good as those of the semi-rigid coaxial cables with closed massive external conductor which, for their part, are ill-suited to continuous cabling processes;

to obtain radio-electrical imperviousness characteristics which are as good as or better than those of coaxial cables with braided external conductive double sheath;

to have good mechanical and radio-electrical matching with the plane terminal structures, for example of the symmetrical strip line, microstrip and printed circuit type;

to use a method of production by an automated continuous process, providing for the fabrication of very great lengths as well as for reduced costs;

to use a relatively large number of separate auxiliary channels, which are service or other channels, for signals of different kinds and frequencies, for example in the case of the cable according to FIG. 3:

two bifilar channels respectively between the conductor 1 and the conductor 5, and between the conductor 1 and the conductor 6;

one bifilar channel between the conductor 5 and the conductor 6;

two bifilar channels respectively between the conductors 7 and 5 and between the conductors 7 and 6 on condition, of course, that the sheath 9 is electrically insulating at the frequencies adopted for the auxiliary channels used;

one bifilar channel between the conductors 1 and 7.

It goes without saying that the invention is not restricted to the two exemplary embodiments that have just been described: the cable can be made in other equivalent forms but always has a symmetrical strip line shaped so that it does not have a leakage of the field of the fundamental mode outwards and at least one ordinary shielding surrounding this symmetrical strip line. Thus, for example, the scope of the invention would not be exceeded if, in the case of small-sectioned cables for example, the flat strip forming the central conductor were to be replaced by an ordinary cylindrical-sectioned conductor.

What is claimed is:

1. A semi-rigid cable for transmission of microwave signals up to a pre-determined frequency comprising:

(a) a semi-rigid flat stripline having length, width, and thickness, and having a central conductor (1)

two parallel metal strips (5, 6), a dielectric (4) disposed between said conductor (1) and strips (5, 6), said strips having a width ($L_1$), where $L_1$ is approximately equal to one of either value NA and N, whichever value is greater, where $L_1$=width of said strips, A=width of said central conductor, e=distance between said two parallel metal strip, N≃; and (b) a conductive shielding sheath (7) completely surrounding and enclosing said stripline.

2. A semi-rigid cable designed for the transmission of microwaves, said cable comprising at least:

one solid linear central conductor with a given width;

a dielectric surrounding said central conductor and having a cross section which is almost rectangular, with two short sides, said dielectric having two parallel, large, plane, external faces with a given width, said faces being parallel with said central conductor and located symmetrically with regard to said central conductor so as to form a dielectric part of a line of a symmetrical strip line type;

two external conductive parallel layers having a given distance between them, formed of continuous metal strips with large faces with a given width, respectively coating major part of each of the two large plane external faces of said dielectric so as to form a symmetrical strip line with said central conductor and said dielectric;

at least one shielding metal sheath completely surrounding and enclosing said symmetrical strip line; and the width of the faces of said external conductive layers being greater than the greatest value among said distance between said two conductive layers and said width of said central conductor.

3. A semi-rigid cable designed for the transmission of microwaves, said cable comprising at least:

one solid linear central conductor with a given width;

a dielectric surrounding said central conductor and having a cross section which is almost rectangular, with two short sides, said dielectric having two parallel, large, plane, external faces with a given width, said faces being parallel with said central conductor and located symmetrically with regard to said central conductor so as to form a dielectric part of a line of a symmetrical strip line type;

two external conductive parallel layers having a given distance between them, formed of continuous metal strips with large faces with a given width, respectively coating major part of each of the two large plane external faces of said dielectric so as to form a symmetrical strip line with said central conductor and said dielectric;

at least one shielding metal sheath completely surrounding and enclosing said symmetrical strip line; and said dielectric has a thickness between the said two external conductor layers substantially of the same size as the width of said central conductor.

4. A semi-rigid cable designed for the transmission of microwaves, said cable comprising at least:

one solid linear central conductor with a given width;

a dielectric surrounding said central conductor and having a cross section which is almost rectangular, with two short sides, said dielectric having two parallel, large, plane, external faces with a given width, said faces being parallel with said central conductor and located symmetrically with regard to said central conductor so as to form a dielectric part of a line of a symmetrical strip line type;

two external conductive parallel layers having a given distance between them, formed of continuous metal strips with large faces with a given width, respectively coating major part of each of the two large plane external faces of said dielectric so as to form a symmetrical strip line with said central conductor and said dielectric;

at least one shielding metal sheath completely surrounding and enclosing said symmetrical strip line; and said external conductive layers of the symmetrical strip line each having a width about three times greater than the greatest value among the distance between these two plane conductive layers and the width of said central conductor.

5. A semi-rigid cable designed for the transmission of microwaves, said cable comprising at least:

one solid linear central conductor with a given width;

a dielectric surrounding said central conductor and having a cross section which is almost rectangular, with two short sides, said dielectric having two parallel, large, plane, external faces with a given width, said faces being parallel with said central conductor and located symmetrically with regard to said central conductor so as to form a dielectric part of a line of a symmetrical strip line type;

two external conductive parallel layers having a given distance between them, formed of continuous metal strips with large faces with a given width, respectively coating major part of each of the two large plane external faces of said dielectric so as to form a symmetrical strip line with said central conductor and said dielectric;

at least one shielding metal sheath completely surrounding and enclosing said symmetrical strip line; and said faces of said dielectric having a width that is greater than the width of said faces of said two external conductive layer of said symmetrical strip line, and wherein said short sides of the rectangular cross section of the dielectric are convex so as to give a rounded shape to the shielding sheath covering said symmetrical strip line.

6. A semi-rigid cable according to anyone of claims 2 to 5 designed for a given mode, further comprising, between said symmetrical strip line and said shielding sheath, a sheath made of a material that is absorbent for microwaves in a spectrum of frequencies where a higher mode than said mode may be propagated.

7. A semi-rigid cable according to claim 6, wherein said absorbent sheath has a cross-section with the shape of an ellipse with a large and a short axis, said large axis being substantially included in a median and parallel plane between said two external conductive layers.

* * * * *